United States Patent [19]

Alexander

[11] 4,020,610

[45] May 3, 1977

[54] ANCHOR FOR STONE BUILDING MEMBER

[75] Inventor: Thomas E. Alexander, Cold Spring, Minn.

[73] Assignee: Cold Spring Granite Company, Cold Spring, Minn.

[22] Filed: Jan. 10, 1975

[21] Appl. No.: 540,246

[52] U.S. Cl. ..... 52/511; 52/125; 52/513; 52/704

[51] Int. Cl.[2] ..... E04C 1/40

[58] Field of Search ..... 52/513, 511, 596–598, 52/390, 398, 125, 704, 709–711, 245, 422; 403/240, 263, 230, 331, 381–384, 353; 248/73, 239

[56] References Cited

UNITED STATES PATENTS

| | | | |
|---|---|---|---|
| 408,278 | 8/1889 | White | 403/381 X |
| 741,043 | 10/1903 | Kann | 52/513 |
| 1,158,362 | 10/1915 | Bevier | 52/422 |
| 1,386,509 | 8/1921 | Kirmes et al. | 52/710 |
| 1,617,555 | 2/1927 | Vallentin | 52/513 X |
| 2,083,116 | 6/1937 | Burgel | 52/391 |
| 2,132,547 | 10/1938 | Sohn | 52/391 X |
| 2,162,695 | 6/1939 | Boyd | 52/513 |
| 2,341,777 | 2/1944 | Hensel | 52/598 |
| 3,299,601 | 1/1967 | Chiville | 52/597 |
| 3,476,912 | 11/1969 | Garrison | 52/125 X |
| 3,605,366 | 9/1971 | Zakim | 52/378 |
| 3,705,002 | 12/1972 | Varlonga | 52/213 |
| 3,786,605 | 1/1974 | Winfrey | 52/513 X |

FOREIGN PATENTS OR APPLICATIONS

| | | | |
|---|---|---|---|
| 106,479 | 2/1939 | Australia | 52/513 |
| 707,585 | 4/1931 | France | 52/513 |
| 720,297 | 12/1931 | France | 52/125 |
| 910,285 | 1/1946 | France | 403/384 |
| 295,944 | 5/1932 | Italy | 52/245 |
| 488,794 | 1/1954 | Italy | 52/513 |
| 173,570 | 3/1935 | Switzerland | 52/511 |
| 252,730 | 4/1927 | United Kingdom | 52/711 |

*Primary Examiner*—Alfred C. Perham
*Attorney, Agent, or Firm*—Merchant, Gould, Smith, Edell, Welter & Schmidt

[57] ABSTRACT

A method and apparatus for preparing slabs of material such as granite for transportation and erection. The apparatus includes a cutting bit and means actuating the bit into the face of the slab so as to form an arcuate slot, widest at the bottom, centered outside the slab. The slot may be dove-tail or inverted-T in configuration, to receive the heads of conventional fasteners, by means of which the slab may be hoisted or transported, as well as being finally secured in its ultimate facing or other location thereby.

4 Claims, 8 Drawing Figures

FIG. 1
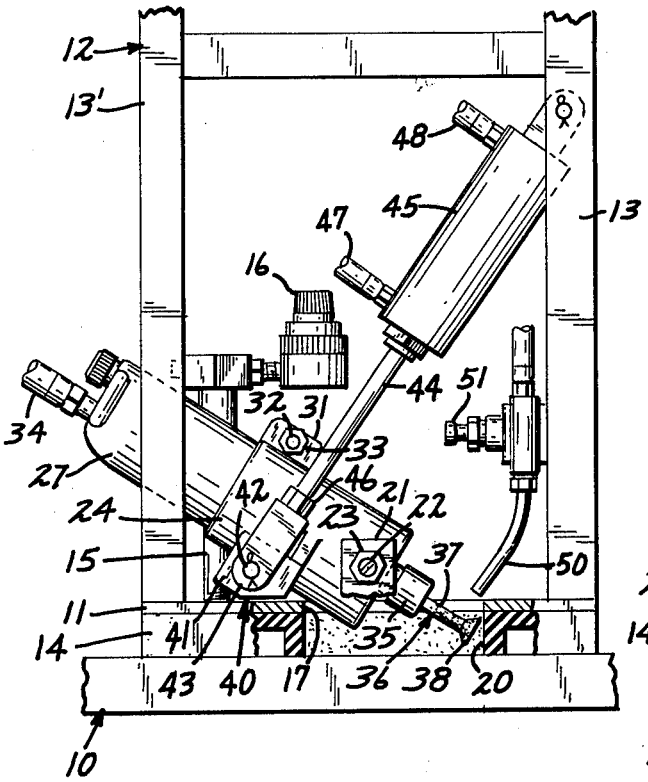
FIG. 2
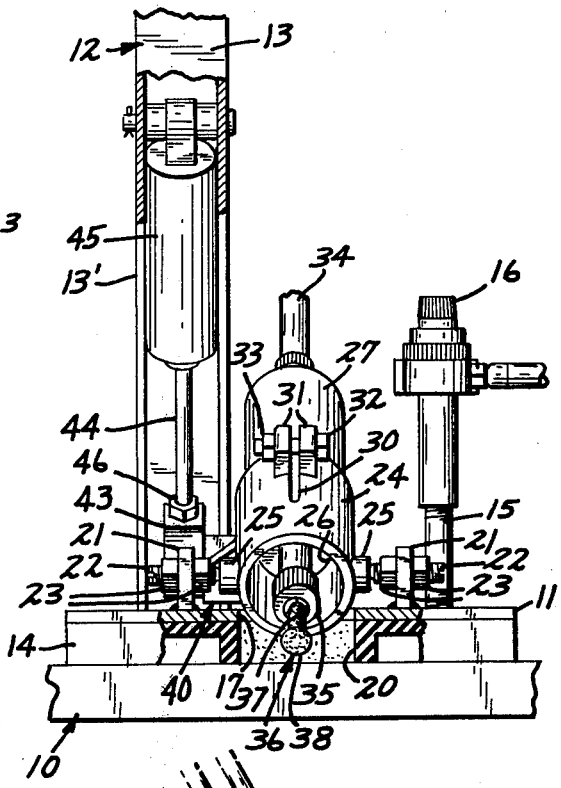
FIG. 7
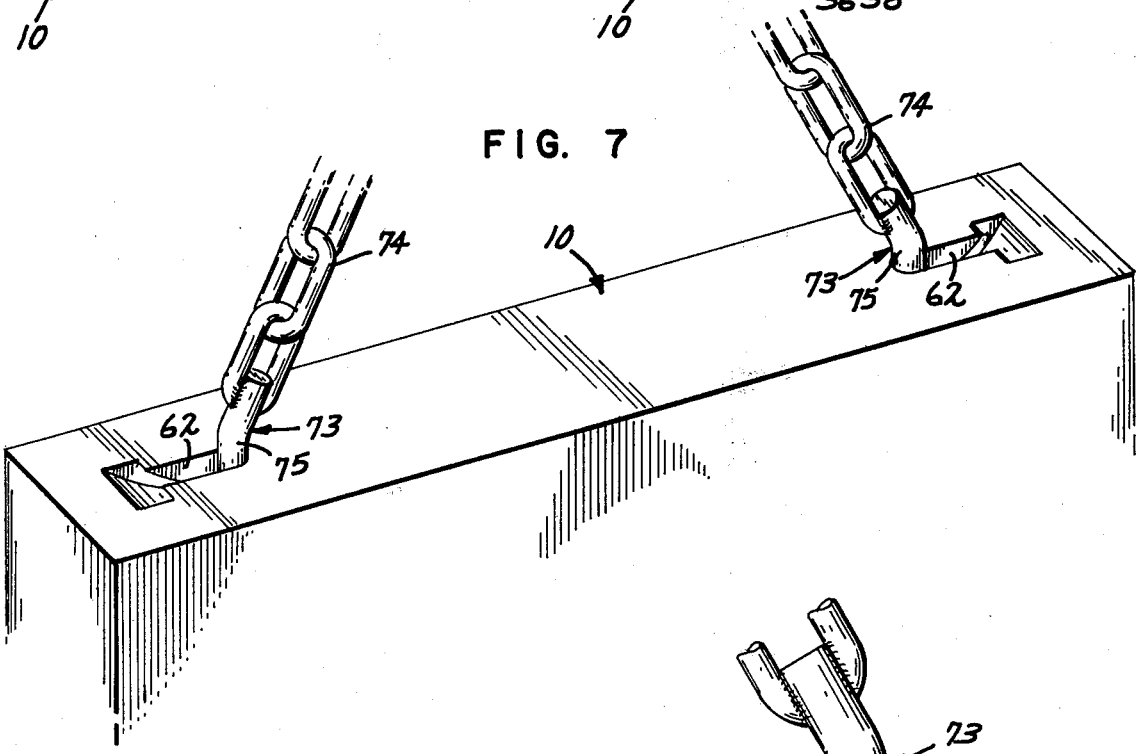
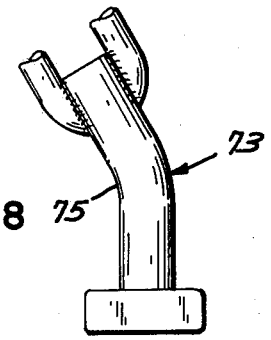
FIG. 8

ANCHOR FOR STONE BUILDING MEMBER

BACKGROUND OF THE INVENTION

This invention relates to the field of building construction, and more particularly to improvements in handling panels or slabs or rigid materials such as slate, marble, glass, and particularly granite, and in for securing them in their intended locations.

Materials of this type are known to be useful in building construction, but are also extremely heavy, so that mechanical aids are necessary in moving and placing them. It is becoming increasing common to use stone slabs or panels as facings or veneers in building construction, which introduces numerous problems. For economy in shipping of the slabs from the quarry, it is desirable that they be as thin as possible to reduce their weight, but thin panels of large area are comparatively fragile and require careful handling in transportation and erection. The thinness of such panels also makes difficult the provision of means by which to secure them into position and to hoist and otherwise transport them without inadvertently applying such stresses that the material is fractured.

SUMMARY OF THE INVENTION

The present invention comprises a method and apparatus for use in transporting and erecting masonry and similar slabs, as well as a method and apparatus for preparing such slabs for transportation and erection. According to the invention an arcuate slot is formed to enter the slab from a surface thereof: the slot is wider at the bottom than at the top, as a dove-tail or inverted-T slot, so that a headed fastener may be slidingly inserted from the face of the slab to a holding position. Thus, no weakening of the edge of the slab occurs, and no deep bores the full size of the fastener head are required to penetrate the slab nearly to its opposite surface. Apparatus for forming this arcuate slot includes a cutter bit having an enlarged end and driven by an air motor to spin about a first axis. The motor driven cutter is mounted to pivot about a second axis, conventionally orthogonal with the first axis and parallel to the surface being penetrated, and means in the form of a fluid pressure actuated cylinder is provided for causing the pivotal movement. The apparatus may be secured to the surface by a vacuum pad fastened under its base, and controls for the cylinder and the air motor are conveniently mounted. Cooling for the cutter bit is provided, as well as a stop arrangement for interrupting the advance of the cutting tool when the axis thereof reaches a predetermined position, preferably one perpendicular to the surface. Although particularly useful in connection with the faces of panels or slabs, the invention may also be used with other surfaces such as edges, where its employment is convenient and advantageous.

Various characteristics, advantages, and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing,

FIGS. 1 and 2 are front and side views of apparatus for use in the practice of the invention;

FIG. 7 shows my invention applied to the edge of a slab; and

FIG. 8 is a fragmentary elevational view of a fastener used in FIG. 7.

DESCRIPTION OF THE PREFERRED EMBODIMENT

Figure 6:
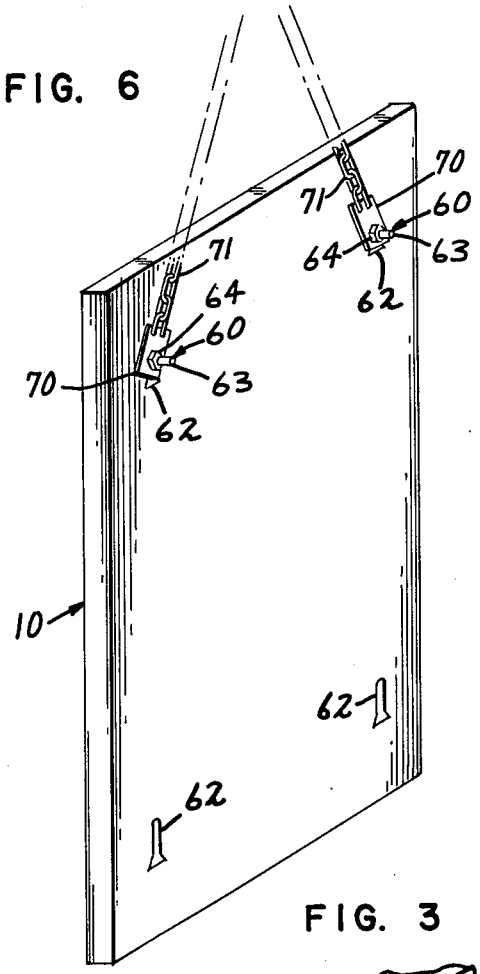
FIG. 6 shows a slab being lifted with the aid of my invention.

In FIGS. 1 and 2 there is shown a slab or panel 10 which is to be prepared for transportation and erection according to my invention. The slab is of a rigid material such as slate, glass, marble, or granite. The apparatus comprises a base plate 11 and a support frame 12 including uprights 13 and 13'. A vacuum pad 14 underlies and is secured to base plate 11, for evacuation through connection 15 to secure the apparatus to the slab at any desired location. Manual means is suggested at 16 for controlling the evacuation of pad 14. Base plate 11 and pad 14 have aligned central apertures 17 and 20.

A pair of ears 21, 21 project upward from plate 11 on opposite sides of the central aperture, and are bored to receive a pair of pivots 22, 22 in the form of V-pointed screws secured in ears 21 by nuts 23 to define a pivotal axis. A mounting means in the form of a sleeve 24 is provided with bosses 25 to receive pivots 22, and is bored at 26 to receive an air motor 27: sleeve 24 is split at 30 and provided with clamping ears 31 traversed by a clamping bolt 32 carrying a nut 33 which may be tightened so that motor 27 is securely gripped. Air for motor 27 is supplied at 34, from a suitable speed control, and the motor includes a collet or other suitable chuck 35 for securely holding a replaceable cutter bit 36 having a shank 37 and an enlarged end 38.

An arm 40 projects laterally from mounting means 24 and includes a flat portion 41 extending generally orthogonally with respect to the pivotal axis. Portion 41 is bored to pass the pin 42 of a clevis 43 threadedly adjustable on the end of the actuator rod 44 of a fluid pressure operated cylinder 45. The position of clevis 43 on rod 44 may be locked by a nut 46. Fluid conduits 47 and 48 are provided for actuation of cylinder 45.

Cutter bit 36 is a specially shaped grinding wheel whose diameter is greater at the end remote from the pivotal axis. Both inverted-T cutters and dove-tail cutters are usable. The bit must cut not only at its head 38 but also along its shank 37. Coolant for cutter bit 36 is supplied through a nozzle 50 secured to upright 13. Also secured to upright 13 is a limit control 51 positioned to be actuated by ears 31 when mounting means 24 pivots into a position where the axis of rotation of cutter bit 36 is perpendicular to the surface.

It will be appreciated that when cutter bit 36 is driven by air motor 27 and pivoted by cylinder 35, the cutter moves through the apertures 17 and 20 into engagement with the slab, and forms therein an arcuate slot. The arc is centered at the axis of pivots 22. If the dove-tail cutter form shown in FIGS. 1 and 2 is used, the arcuate slot is widest at its bottom and converges outwardly to provide overhangs on both sides of a central slot, the width of the latter being the diameter of the shank of the cutter. The maximum depth of the slot below the surface of slab 10 on which the apparatus rests is determined by the distance that cutter bit 36 extends out of chuck 35. If the axis of cutting bit 36 is not orthogonal with that of pivots 22, the slot at the surface of the slab will be curved rather than straight, and one edge of it will be deeper than the other, so the orthogonal relation is preferred.

In use, the apparatus is placed on the surface of the material with the pivotal axis orthogonal to the direction at which the slot is to extend, and directly over the point at which the slot is to terminate, the apparatus being in the position shown in FIG. 1. Cutter bit 36 is adjusted in chuck 35 to give the desired depth for the slot bottom. Pad 14 is evacuated to secure the apparatus to the slab. Air motor 27 is set in operation to drive chuck 35 and cutter bit 36, and flow of coolant through nozzle 50 is initiated. Now fluid flow through cylinder 45 is provided and the cylinder pulls on shaft 44, pivoting mounting means 24 clockwise about pivots 22 until cutting bit 36 engages the slab surface. Further operation of the cylinder moves the bit into the material, causing it to cut or abrade away a slot which is the envelope of the movement of the pivoting cutter bit. This continues until ears 31 engage member 51, which arrests the operation of cylinder 45 and may, if desired, reverse it. After the cutter is withdrawn from the slab, the pad is released and the apparatus may be moved to the next location.

Figure 4:
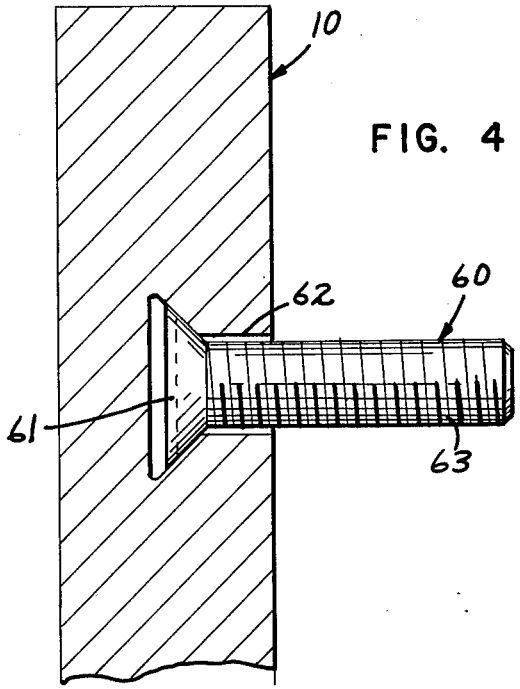
FIGS. 4 and 5 are fragmentary sectional views along the lines 4—4 and 5—5 respectively of FIG. 3.

The slots cut as just described are adapted to receive conventional headed fasteners. The cutter bit of dovetail configuration forms slots to receive the heads of fasteners having the conventional "flat" head, which is outwardly flat and inwardly tapering. The head of the fastener is simply inserted into the slot and slid along its arc, entering more and more deeply into the material and becoming more and more perpendicular, until it reaches the position shown in FIGS. 3–5. The fastener 60 has a head 61 contained within the slot 62, and a shank 63 which projects out of the slot and is threaded to receive a nut 64.

Figure 3:
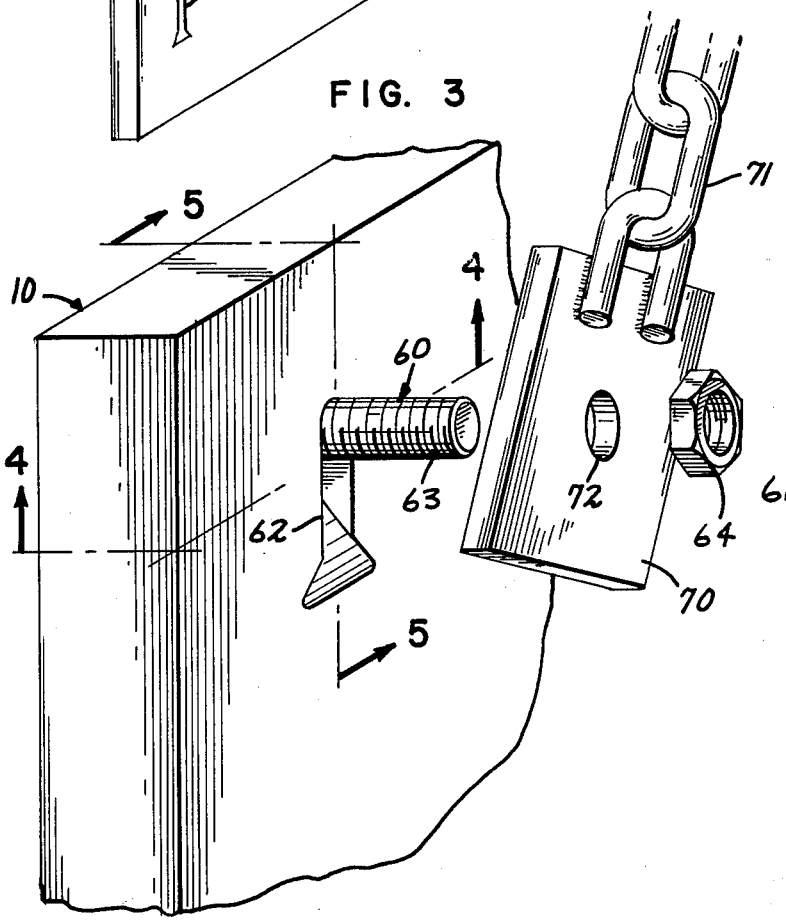
FIG. 3 is a detail view of a slab having my invention associated with its face near a corner.

FIGS. 3 and 6 show how fasteners so secured in the face of a slab of material may be used for lifting and transporting the slab. A hoisting attachment comprises a pair of plates 70 welded to the ends of a chain or chains 71. The plates are bored at 72 to pass fastener 63 and to be held by nut 64. When the nuts are tightened, the plates press against the slab and prevent cocking of the fasteners in the slots.

An alternative lifting arrangement is shown in FIG. 7, where the arcuate slots are cut into the edge rather than the face of a slab, but in a direction parallel to the face. The cutter bit used to form these slots was an inverted-T cutter, and the slot configuration is slightly different from before, in that it accepts the head of conventional square- or hexagon-headed bolts. FIG. 8 shows such a bolt at 73 welded to the end of a chain 74. An angular bend 75 in the shank of bolt 73 makes its use for this purpose more convenient.

Figure 5:
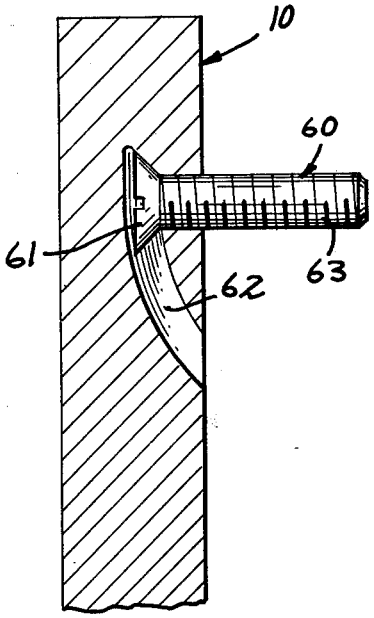

Inspection of FIG. 6 shows that the four slots formed therein are all cut in the same direction. When the slab is erected, this means not only that the fasteners in the slots will pull the slab tightly against the backing, but that they will support at least a portion of the weight of the slab, as indicated in FIG. 5.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. As an article of manufacture for use with a generally elongated fastening pin device, a slab of generally rigid natural stone having a flat surface and an arcuate slot extending obliquely through said surface for fixedly receiving an elongated fastening pin device therein, the center of the arc lying outside of the slab and the bottom of the slot being wider than the top thereof, said arcuate slot having generally parallel opposed walls each of which has an outwardly extending bottom portion and each of which intersects the slab surface to define an elongated opening in the flat surface with generally constant width along the length.

2. The structure of claim 1 in which said arcuate slot has an inverted-T cross section.

3. The structure of claim 1 in which said arcuate slot has a dove-tail cross section.

4. The structure of claim 1 wherein said parallel opposed walls are each generally perpendicular to said flat surface.

* * * * *